US005540041A

United States Patent [19]

Campbell et al.

[11] Patent Number: 5,540,041

[45] Date of Patent: Jul. 30, 1996

[54] METHOD OF AND APPARATUS FOR STRESS RELIEVING MULTISTRANDED CABLE

[75] Inventors: Steven R. Campbell, Owensboro, Ky.; Clinton E. Watkins, Villa Rica, Ga.

[73] Assignee: Southwire Company, Carrollton, Ga.

[21] Appl. No.: 304,969

[22] Filed: Sep. 13, 1994

[51] Int. Cl.[6] ..... D01H 1/00; D01H 13/26

[52] U.S. Cl. ..... 57/66.5; 57/13; 57/67; 57/68; 57/264; 57/314

[58] Field of Search ..... 57/264, 310, 311, 57/314, 6, 13, 14, 9, 58.32, 66.5, 67, 68

[56] References Cited

U.S. PATENT DOCUMENTS

| | | | |
|---|---|---|---|
| 2,484,179 | 10/1949 | MacCreadie | 57/68 |
| 3,005,304 | 10/1961 | Holm | 57/311 |
| 3,413,793 | 12/1968 | Stine et al. | 57/68 |
| 3,728,854 | 4/1973 | Ramunas | 57/68 |
| 4,087,956 | 5/1978 | Gre | 57/58.54 |
| 4,332,131 | 6/1982 | Palsky et al. | 57/13 |
| 4,446,688 | 5/1984 | Ueda | 57/58.32 |
| 4,549,394 | 10/1985 | Preussner | 57/9 |
| 4,599,853 | 7/1986 | Varga Papp | 57/9 |
| 4,628,676 | 12/1986 | Lepach et al. | 57/264 |
| 4,642,979 | 10/1987 | Tomioka et al. | 57/264 |
| 4,887,421 | 12/1989 | Haislet | 57/58.54 |

FOREIGN PATENT DOCUMENTS

| | | | |
|---|---|---|---|
| 461844 | 12/1991 | European Pat. Off. | 57/68 |

*Primary Examiner*—William Stryjewski
*Attorney, Agent, or Firm*—Stanley L. Tate; James W. Wallis, Jr.

[57] ABSTRACT

Apparatus for stress relieving multistranded cable includes a rotatable cradle of a double twist strander which carries a plurality of guide sheaves, a dual wheel capstan, and a take-up reel and a pay-off reel arranged to substantially reduce the length of the path of travel of the advancing cable and to impart stress relieving rotation and tension to the advancing cable. After the cable has been payed off of a stationary pay-off reel, it is advanced to a pair of metering sheaves to fix the starting point of the stress relieving process. From the metering sheaves, the cable advances to the dual wheel capstan mounted for rotation with the take-up reel on the cradle of the strander.

23 Claims, 2 Drawing Sheets

50
52
54
56
58
60
62
64
66
68
70
72
78
80
82
84
86
88
90
92
100
101
102
103
104
105
106
107
108
109
110
118
120
122
124
126
130
131
132
134
136
138
140
142
144
146
C
D 52
54
56
58
60
62
64
66
68
70
72
74
76
78
80
82
84
86
100
102
103
104
106
108
109
110
112
114
116
118
120
122
124
130
131
132

METHOD OF AND APPARATUS FOR STRESS RELIEVING MULTISTRANDED CABLE

FIELD OF THE INVENTION

The present invention relates to an apparatus for and a method of stress relieving a multistranded cable of indeterminate length, and more particularly to an apparatus for and a method of relieving stresses entrained in multistranded cable having one or more layers of helically wound wire during the manufacturing thereof.

BACKGROUND OF THE INVENTION

According to the prior art, multistranded cables are formed by helically winding a plurality of individual steel strands together and in some cable configurations, by helically wrapping one or more layers of strands about one or more central core wires. Multistranded cables formed in this manner include a variety of cross-sectional configurations having differing numbers of layers and differing number of strands in each layer. The different layers may be stranded in different lay directions.

For severe service applications, such as for oil well logging operations and the like, the cable may be enclosed in a protective outer sheath, i.e., an armor jacket which overwraps the cable in a substantially continuous helical manner along the length of the cable. The lay of the armor jacket may be the same or different from the lay of the underlying layer(s) of helically wrapped wire strands. The armor jacket is generally intended to withstand impact damage and corrosive damage generated by moisture- and/or corrosive chemical-laden environments in which the cable is installed, including the severe environment of oil wells or other hostile environments which are typically encountered during oceanographic studies or other naval applications.

It is important that the cable be straight and accurately positioned whether suspended in a relatively narrow bore of an oil well or along the ocean floor. To that end, it is desirable that such cables be manufactured so that they will lay extremely straight when they are unreeled, without twisting, spiraling, casting, or kinking when the cable is unreeled so as to insure accurate placement within the oil well, on the ocean floor or other environment in which the cable is used. In that regard, an important problem in the manufacture of helically wrapped multistranded cables is the undesirable introduction of stresses to the cable during manufacture thereof which are known to cause the cable to twist, spiral and curl up or kink when unreeled. It is believed that the cause of such undesirable effects is the result of inherent stress induced in the strands by reason of friction in the guiding system for the strands during the manufacturing process, resulting in unwanted stresses along the length of the cable. Accordingly, it is important that the multistranded cable be stress relieved prior to use so that it will lay extremely straight when unreeled.

One prior art apparatus 10 for stress relieving multistranded cable is shown in FIGS. 1 and 2. A pay-off reel or supply bobbin 12 for carrying and dispensing a supply of multistranded cable 14 to be stress-relieved is carried on a frame 16 in a standard portal arm shaftless arrangement, the frame 16 being securely mounted to a large motorized turntable 18. The frame 16 includes a pair of frame arms 20 which are adjustably secured to a crossbar 22. The frame arms 20 further include a pair of pintles 24 extending inwardly to secure the pay-off reel 12 in a direction coincident with its axis of rotation. The turntable 18 is constructed with a heavy platform 28 having a diameter exceeding twelve feet for supporting the frame 16 and constructed to carry the weight of the pay-off reel 12 and its supply of cable 14 during operation of the apparatus 10. A large drive motor (not shown) rotates the turntable 18 about a vertical axis A. The drive motor requires a substantial power input necessary to overcome the inertia of the turntable 18 together with the aggregate weight of the frame 16 and the reel 12.

The cable 14 is payed off the pay-off reel 12 in the direction of rotation shown by the arrow and then travels in an upward direction in substantial alignment with the axis of rotation of the turntable 18 to a guide sheave 26. The cable 14 is then advanced in the direction of arrow B over the guide sheave 26 through a strain gage 30 of known design. The cable 14 is further advanced through additional guide sheaves 32, 34, 36 separated one from the next by substantial cable runs and then to a dual wheel capstan 38 separated from guide sheave 36 by another substantial cable run. The advancing cable 14 is carried through multiple grooves formed in each wheel 40, 42 of the capstan 38 with a predetermined tension to stress relieve the advancing cable 14, which is then coiled onto take-up reel 44 mounted for rotation in a stationery portal-arm take-up stand 46 similar to that mounted to the turntable 18. This final cable run is likewise of a substantial length.

In operation, the rotational speed of the pay-off reel 12 is controlled to rotate at relatively slow angular speeds not exceeding fifty revolutions per minute during which time the tension at the take-up stand 46 is controlled to direct the advancing cable 14 through the capstan 38 to relieve stresses in the cable 14. This operating speed restriction is made necessary due to the heavyweight of the pay-off reel 12 and turntable 18 resulting in undesirable high energy input and maintenance requirements. Another important problem with this prior art apparatus is the plurality of relatively long cable runs between the various guide sheaves, capstan 38 and take-up stand 46, which cable runs require extended operating space necessary to complete the cable strain relief process.

SUMMARY OF THE INVENTION

It is an object of the present invention to provide a stress relief apparatus for stress relieving multistranded cable assemblies, especially oil well logging cables.

It is another object of the present invention to provide a stress relief apparatus which operates at significantly faster production speeds than the conventional turntable apparatus.

It is a further object of the present invention to provide a stress relief apparatus which operates with a substantially reduced energy requirement and with substantially reduced operating space requirements.

The present invention provides a fast, compact and energy efficient stress relief apparatus for stress relieving multistranded cables, and especially helically wound multistranded cables, such as those used in oil well logging. The apparatus includes a rotatable cradle, similar to that of a double twist strander without a bow, which carries a multigroove dual wheel capstan and its drive, and a take-up reel and its drive located downstream from a pay-out reel in an arrangement that significantly reduces the length of the cable path, as compared to the cable path of the conventional apparatus. In operation, a multistranded cable to be stress relieved is payed off the pay-off reel which is fixedly mounted to a support surface and advanced to a pair of metering sheaves, which define the beginning or upstream end of the tensile zone for the system. The metering sheaves include a pair of guide wheels each formed with two grooves for guiding the cable in a double wrapping along a path tangential to the paired wheels to fix the starting point of the stress relieving zone.

The cable is further advanced to a strain gauge for measuring the tension in the cable in the stress relieving zone and then into a passageway along the rotational axis of the cradle and to a first or upstream pair of guide sheaves. From the first guide sheave pair, the cable is advanced through a second or downstream guide stream pair and into the multi-groove dual wheel capstan which defines the downstream end of the tensile or stress relieving zone and from the capstan, to the take-up reel. The rotation of the cradle together with the tensile force applied to the cable between the capstan and the metering sheaves impart stress relief to the advancing cable. In most cases, the cradle is rotated in the direction of the lay of the outermost layer of the cable, the speed of rotation being adjustable up to 400 to 500 percent faster than the operating speeds of the conventional turntable apparatus. In operation, the apparatus of the present invention places the advancing and rotating cable under a tension of between about 10% and about 90% of the ultimate tensile stress (UTS) of the cable as it is advanced between the paired metering sheaves and the dual wheel capstan. Energy requirements are also minimized, primarily because of a sharp reduction in a power requirement due to the elimination of the heavy motorized turntable of the conventional apparatus.

With the foregoing and other objects, advantages and features of the invention that will become hereinafter apparent, the nature of the invention may be more clearly understood by reference to the following detailed description of the invention, the appended claims, and to the several views illustrated in the attached drawings.

DETAILED DESCRIPTION OF THE INVENTION

Figure 1:
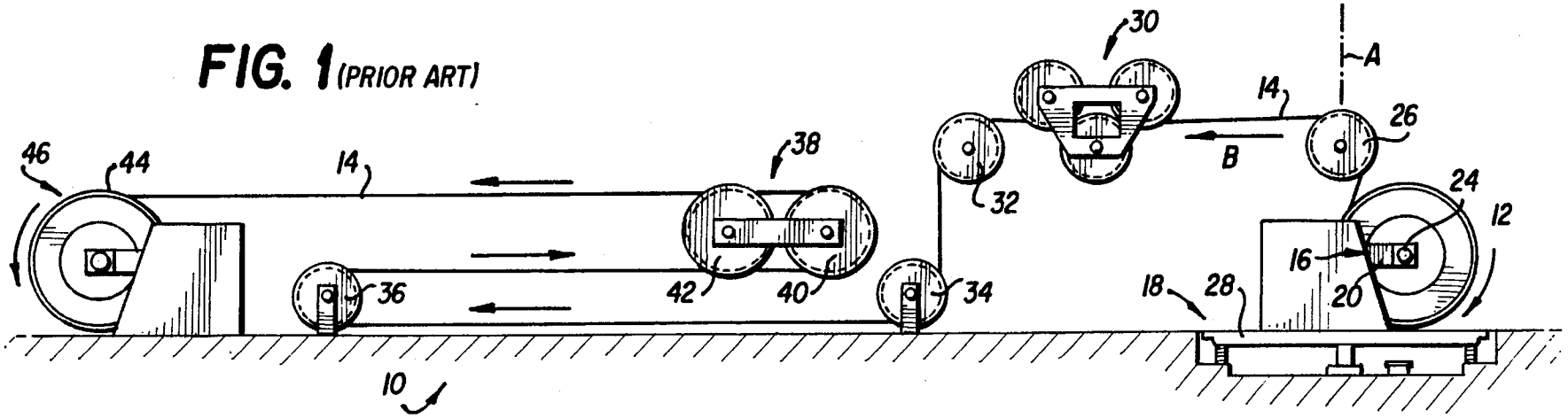
FIG. 1 (PRIOR ART)
FIG. 1 is a side elevational view of a prior art apparatus for stress relieving a multistranded cable.
Figure 2:
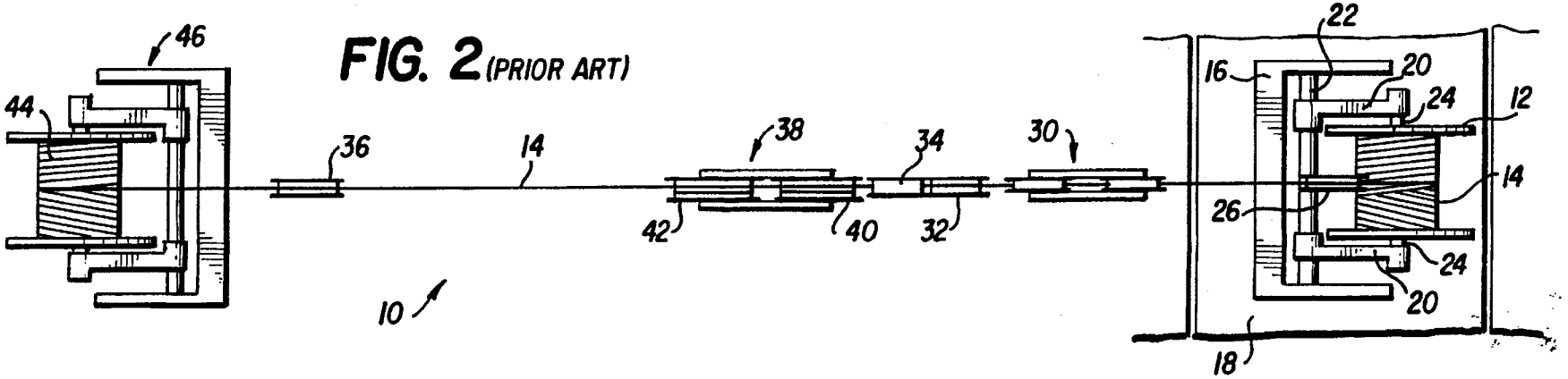
FIG. 2 (PRIOR ART)
FIG. 2 is a top plan view of the prior art apparatus shown in FIG. 1.
Figure 3:
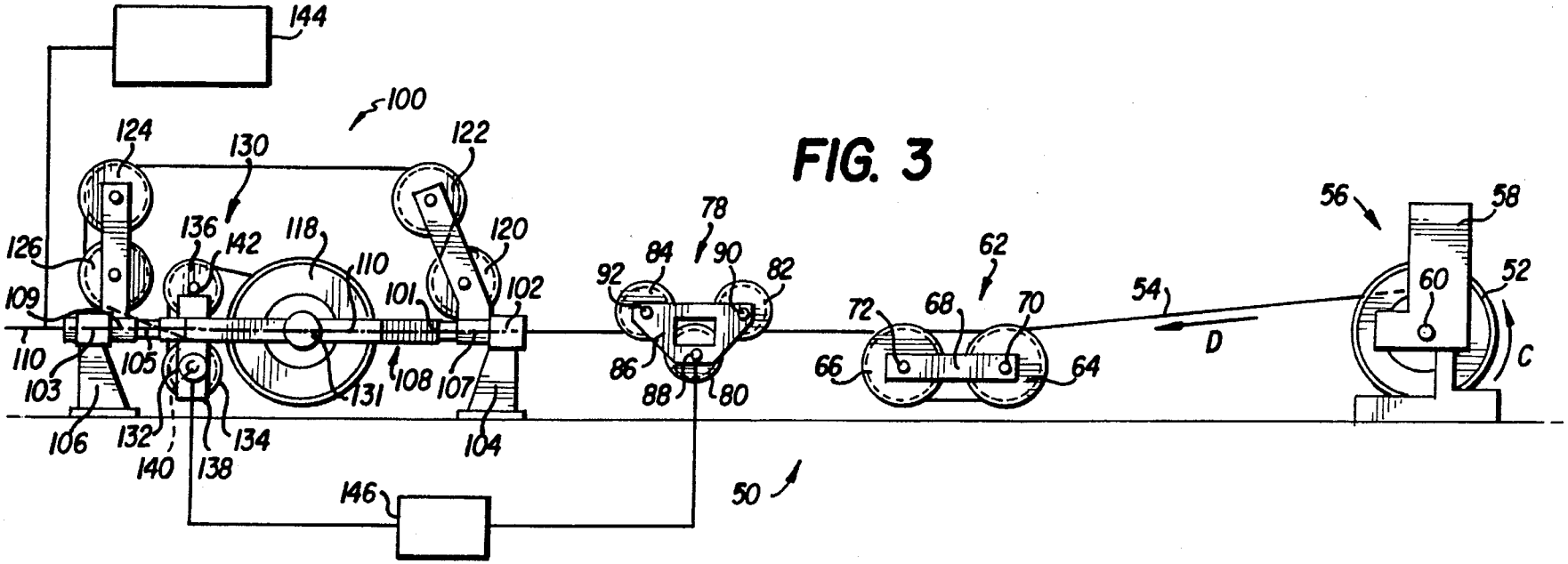
FIG. 3 is a side elevational view of the stress relieving apparatus of the present invention, showing a double twist strander for supporting a take-up reel while exerting a controlled tension on the advancing multistranded cable.
Figure 4:
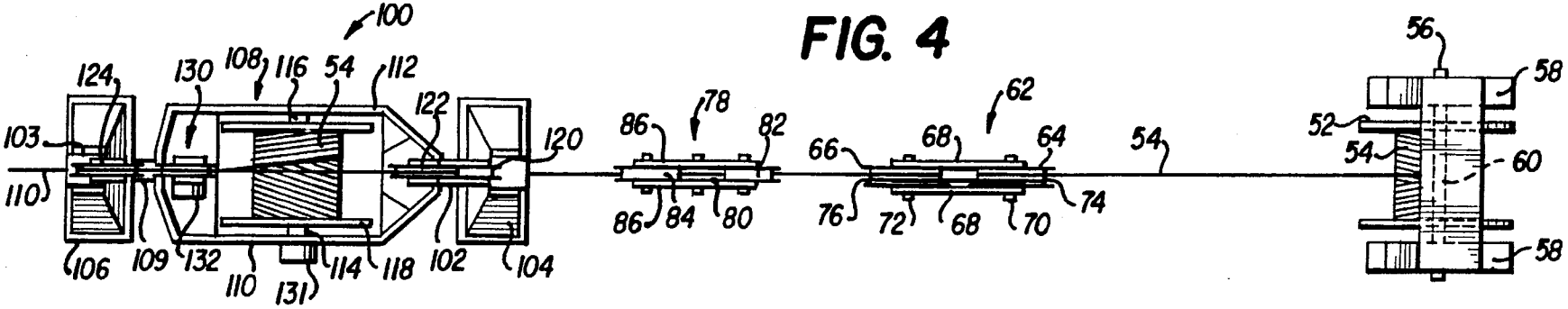
FIG. 4 is a top plan view, partly broken away, of the stress relieving apparatus shown in FIG. 3, showing additional features of the present invention.

Referring now in detail to the drawings wherein like parts are designated by like reference numerals throughout, there is illustrated in FIGS. 3 and 4 a stress relieving apparatus 50 of the present invention for stress relieving multistranded cable having one or more layers of helically wound wire strands. More particularly, a pay-off reel or supply bobbin 52 for carrying and paying out a multistranded cable 54 to be stress-relieved is supported for rotation on a stationary pay-off stand 56. The pay-off stand 56 includes a pair of frame arms 58 and pintles 60 to secure the pay-off reel 52 for rotation.

The cable 54 is payed off of the pay-off reel 52 in the direction of rotation shown by arrow C and then in the direction shown by arrow D to paired metering sheaves 62. The metering sheaves 62 include a pair of sheaves 64, 66 held in tandem arrangement by a pair of side rails 68 and supported for rotation by a pair of axles 70, 72, respectively. The guide wheels 64, 66 are formed with at least two circumferential grooves 74, 76 for guiding the advancing cable 54 with a double wrap, i.e., two wraps about the sheave pair 64, 66 in grooves 74, 76. The metering sheaves 62 fix the starting point of the stress relieving or tensile zone as will be more fully described hereinafter.

The cable 54 is then advanced through a conventional strain gage 78 having a first single-groove guide wheel 80 held in off-center alignment between second and third single-groove guide wheels 82, 84. The guide wheels 82, 84, 86 are secured in coplanar relationship by a pair of side plates 86, the guide wheels 82, 84, 86 being supported for rotation between the side rails 86 with axles 88, 90, 92, respectively. A strain gauge (not shown) is fitted between the first guide wheel 80 and its respective axle 88 to detect and measure tension, and hence strain, in the cable in a conventional manner.

The cable 54 is then further advanced into the double twist strander apparatus 100 of the present invention. More particularly, the cable 54 is directed through keyways or passageways 102, 103 extending through a pair of cradle stands or supports 104, 106. The cradle stands 104, 106 rotatably support the longitudinal end shafts 101, 105 of a cradle 108 of the double twist strander for rotation at bearings 107, 109 about a longitudinal axis of rotation 110 coincident with the keyways 102, 103. The cradle 108 also includes a pair of side rails 110, 112 through which a pair of pintles 114, 116 are projected at an intermediate position thereof to support a take-up reel 118 for rotation. Take-up reel 118 is driven by a motor 131. The axis of rotation of the take-up reel 118 is substantially perpendicular to the longitudinal axis of rotation 110 of the cradle 108. Four single-groove guide sheaves 120, 122, 124, 126 are mounted in pairs 120, 122 and 124, 126 to the cradle stands 104, 106, respectively. The advancing cable 54 is guided from upstream the strander apparatus 100 through the keyway 102, through the first pair of guide sheaves 120, 122 and thence to the second pair of guide sheaves 124,126. The sheaves 120, 122, 124, 126 suspend the advancing cable 54 by a distance sufficient to prevent interference of the cable with the rotating cradle 108 and the take-up reel 118.

The cable 54 is trained through the inner opposing grooves of the first pair of guide sheaves 120, 122 and around the outer grooves of the second pair of guide sheaves 124, 126, and after passing through the downstream keyway 103 is directed to a multi-groove dual wheel capstan 130 which is powered for rotation by a direct current capstan drive motor 132. The capstan 130 includes a pair of guide wheels 134, 136 held in tandem arrangement by a pair of side rails 138 and supported for rotation by a pair of axles 140, 142 respectively. The guide wheels 134, 136 are each formed with one to fifteen, and preferably six to seven circumferential grooves for guiding and tensioning the advancing cable 54 along its path of travel. The cradle 108 is powered for rotational about bearings 107, 109 by a cradle drive motor 144 connected to the downstream shaft 105 of the rotatable cradle 108. The sheaves and guide wheels used in the apparatus 50 preferably have a diameter of between about 40 times to about 100 times the diameter of the largest cable to be stress relieved in accordance with the operation of the invention.

In operation, the multistranded cable 54 to be stress relieved is payed off of the fixedly mounted pay-off reel 52 and advanced to the pair of metering sheaves 62, which define the starting point of the tensile zone, thence through the strain gauge 78 and to the cradle 108 of the strander apparatus 100 to the end of the tensile zone at the capstan 130, after which the cable 54 is reeled up by the take-up reel 118. The cable 54 is thus stress relieved by the combination of rotation and tension applied to the cable in the tensile zone of between 10% and 90% of UTS. The cradle 108 is generally rotated in the direction of lay of the outer layer of the helically wound strands, although rotation of the cradle in a direction substantially opposite to the lay of that outer layer may be desirable depending on the particular cable design.

The stress applied to the cable 54 is controlled via a feedback loop controller 146 which compares a desired tensile stress value or range of values with the strain value measured at the strain gauge 78, and adjusts the torque of the capstan drive motor 132 to achieve the desired tension. For best results, the cable is preferably strained to a point close to or slightly above its elastic limit.

It will be appreciated by the skilled artisan that the required forced applied by the capstan drive motor 132 and by the speed of rotation of the cradle 108 can be varied individually or together to effect a desired stress relief of cable having various sizes, configurations, compositions, and tempers. It will also be appreciated that a substantially smaller installation space is required for the apparatus 50 of the present invention. Furthermore, the apparatus of the present invention is operable with at significantly faster production speeds, and with smaller energy requirements due to the elimination of the heavy turntable of the conventional apparatus.

Although a preferred embodiment of the present invention has been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for stress relieving an indeterminate length of multistranded cable having at least one helically wound strand of wire, comprising:

only one pay-off reel at an upstream location for paying off a multistranded cable to be stress relieved;

a cradle located downstream of said pay-off reel;

take-up means mounted on said cradle for taking up the cable after it has been stress relieved;

means mounted between said take-up means and said pay-off reel for applying a tensile force to said cable; and means for rotating said cradle about an axis such that the cable is rotated in one direction about its longitudinal axis whereby the multistranded cable is substantially stress relieved by the combination of tension applied thereto and the rotation thereof.

2. Apparatus according to claim 1, wherein said tensile applying means comprises a capstan mounted to said cradle for rotation therewith and metering sheave means located downstream of said pay-off reel, said cable being frictionally engaged at said capstan and at said metering sheave means.

3. Apparatus according to claim 2, including strain gauge means operatively engaging said cable between said capstan and said metering sheave means for measuring the strain in said cable.

4. Apparatus according to claim 3, including means for driving said capstan, control means connected between said capstan driving means and said strain gauge for controlling the tension in said cable in response to the measured strain in said cable.

5. Apparatus according to claim 2, wherein said cradle means comprises a pair of side rails, first and second bearings mounted along the rotational axis of said cradle, said side rails terminating in first and second longitudinal shafts, said shafts being rotatably mounted in said first and second bearings, respectively.

6. Apparatus according to claim 5, wherein said take-up means is mounted for rotation about an axis perpendicular to the axis of rotation of said cradle.

7. Apparatus according to claim 6, wherein said take-up means comprises a take-up reel, said take-up reel being rotatably and removably mounted between a pair of pintles, each pintle being supported on a respective side rail of said cradle.

8. Apparatus according to claim 7, including means mounted to said cradle and being rotatable therewith for driving said take-up reel to take up said cable.

9. Apparatus according to claim 5, including means mounted adjacent said first and second bearings for guiding said cable radially away from the rotational axis of said cradle, then substantially parallel to said rotational axis, and then radially inwardly toward said rotational axis.

10. Apparatus according to claim 9, including first and second cradle support stands for supporting the first and second bearings, said guiding means comprising first and second pairs of guide sheaves, the first pair of guide sheaves being mounted to said first cradle support stand and said second pair of guide sheaves being mounted to said second cradle support stand.

11. Apparatus according to claim 10, including first and second keyways in said first and second cradle support stands, respectively, said cable extending through said first keyway, about said first and second pair of guide sheaves and through said second keyway to said capstan.

12. Apparatus according to claim 2, wherein said capstan is a grooved dual wheel capstan, each wheel of said capstan having between one and fifteen grooves.

13. Apparatus according to claim 1, wherein said tension applying means applies a tensile force at or slightly above the elastic limit of the cable.

14. Apparatus for stress relieving an indeterminate length of multistranded cable having at least one helically wound strand of wire, comprising a pair of spaced cradle support stands, a bearing mounted in each stand, a cradle having a rotational axis, two side rails and two end shafts, said shafts being rotatably mounted in a respective bearing of a respective cradle support stand for rotating said cradle about said axis, a capstan mounted to said cradle and rotatable therewith for frictionally engaging a multistranded cable to be stress relieved, a take-up reel mounted to said cradle and rotatable therewith for taking up the cable from said capstan after it has been stress relieved, only one pay-off reel located upstream of said cradle for paying off the cable to the cradle assembly, and a pair of metering sheaves disposed between said cradle and said pay-off reel for frictionally engaging said cable, said metering sheaves and said capstan being operative to generate a tensile force in said cable, said cradle being rotatable about its rotational axis so as to rotate the cable about its longitudinal axis whereby the combination of the tensile force in said cable and the rotation of said cable are effective to substantially relieve the stress in said cable.

15. Apparatus according to claim 14, including drive motors mounted on said cradle and rotatable therewith for driving said capstan and said take-up reel.

16. Apparatus according to claim 14, including a strain gauge operatively engaging said cable between said capstan and said metering sheaves for measuring the strain in said cable, control means connected between said capstan drive motor and said strain gauge for controlling the tension in said cable in response to the measured strain in said cable.

17. A method of stress relieving an indeterminate length of multistranded cable comprising the steps of:

paying off a multistranded cable to be stress relieved from only one stationary pay-off reel, said cable having a longitudinal axis and at least one helically wound strand of wire;

passing the multistranded cable to a tension zone downstream of said pay-off reel;

applying tension to the cable in said tension zone;

taking up said cable on a take-up reel by rotating said take-up reel about its axis; and rotating said take-up reel about an axis perpendicular to the reel axis to thereby rotate said cable about its longitudinal axis in said tension zone.

18. Method according to claim 17, further comprising the steps of measuring the strain on said cable resulting from applying tension to said cable in said tension zone and adjusting the tension applied to said cable in said tension zone to a predetermined level at or slightly above the elastic limit of said cable.

19. Method according to claim 17, further comprising the steps of rotating the cable about its longitudinal axis in the direction of the lay of the at least one helically wound strand or wire.

20. Method according to claim 17, further comprising the step of adjusting the tension in said cable from 10% to 90% of the ultimate tensile strength of the cable.

21. Apparatus for stress relieving an indeterminate length of multistranded cable having at least one helically wound strand of wire, comprising:

a pay-off means for paying off a multistranded cable at an upstream location;

a cradle located downstream of said pay-off means;

take-up means mounted on said cradle means for taking up the cable after it has been stress relieved;

means mounted between said take-up means and said pay-off means for applying a tensile force to said cable; and means for rotating said cradle about an axis such that the cable is rotated in one direction about its longitudinal axis, said a tensile force applying means comprising a capstan mounted to said cradle for rotation therewith, metering sheave means located downstream of said pay-off means, said cable being frictionally engaged at said capstan and at said metering sheave means, and strain gauge means operatively engaging said cable between said capstan and said metering sheave means for measuring the strain in said cable.

22. Apparatus according to claim 21, including means for driving said capstan, control means connected between said capstan driving means and said strain gauge for controlling the tension in said cable in response to the measured strain in said cable.

23. Apparatus for stress relieving an indeterminate length of multistranded cable having at least one helically wound strand of wire, comprising a pair of spaced cradle support stands, a bearing mounted in each stand, a cradle having a rotational axis, two side rails and two end shafts, said shafts being rotatably mounted in a respective bearing for rotating said cradle about said axis, a capstan mounted to said cradle and rotatable therewith for frictionally engaging a multistranded cable to be stress relieved, a take-up reel mounted to said cradle and rotatable therewith for taking up the cable from said capstan, a pay-off reel located upstream of said cradle assembly for paying off the cable to be stress relieved to the cradle, and a pair of metering sheaves disposed between said cradle and said pay-off reel for frictionally engaging said cable, said metering sheaves and said capstan being operative to generate a tensile force in said cable, a strain gauge operatively engaging said cable between said capstan and said metering sheaves for measuring the strain in said cable, control means connected between said capstan and said strain gauge for controlling the tension in said cable in response to the measured strain in said cable, said cradle being rotatable about its rotational axis so as to rotate the cable about its longitudinal axis whereby the combination of the tensile force in said cable and the rotation of said cable are effective to substantially relieve the stress in said cable.

* * * * *